US007438882B2

(12) United States Patent
Goodwin et al.

(10) Patent No.: US 7,438,882 B2
(45) Date of Patent: Oct. 21, 2008

(54) GEL AND POWDER MAKING

(75) Inventors: Andrew James Goodwin, Douglas (IE); Stuart Leadley, Midleton (IE); Pierre Chevalier, Brussels (BE); Bhukandas Parbhoo, Penarth (GB)

(73) Assignee: Dow Corning Ireland Limited, Middleton, Co. Cork (IE)

( * ) Notice: Subject to any disclaimer, the term of this patent is extended or adjusted under 35 U.S.C. 154(b) by 163 days.

(21) Appl. No.: 10/510,538

(22) PCT Filed: Apr. 8, 2003

(86) PCT No.: PCT/EP03/04344

§ 371 (c)(1),
(2), (4) Date: May 27, 2005

(87) PCT Pub. No.: WO03/086029

PCT Pub. Date: Oct. 16, 2003

(65) Prior Publication Data

US 2005/0226802 A1 Oct. 13, 2005

(30) Foreign Application Priority Data

Apr. 10, 2002 (GB) ..... 0208263.4

(51) Int. Cl.
*C01B 33/18* (2006.01)

(52) U.S. Cl. ..... 423/337; 423/608; 423/624; 423/625; 423/632

(58) Field of Classification Search ..... None
See application file for complete search history.

(56) References Cited

U.S. PATENT DOCUMENTS

| | | | | |
|---|---|---|---|---|
| 4,960,850 | A * | 10/1990 | Billet et al. | 528/23 |
| 5,234,723 | A | 8/1993 | Baracz | |
| 5,414,324 | A | 5/1995 | Roth et al. | |
| 5,939,151 | A | 8/1999 | Prichard et al. | |
| 6,387,341 | B1 | 5/2002 | Sarrade et al. | |
| 2002/0192138 | A1 | 12/2002 | Yuill | |

FOREIGN PATENT DOCUMENTS

| | | | |
|---|---|---|---|
| DE | 3500080 | * | 7/1986 |
| JP | 56166230 | | 12/1981 |
| JP | 6330326 | | 11/1994 |
| JP | 7018076 | | 1/1995 |
| JP | 8127865 | | 5/1996 |
| JP | 11-198281 | * | 7/1999 |
| JP | 11-256338 | * | 9/1999 |
| WO | 02/28548 | | 4/2002 |
| WO | 02/35576 | | 5/2002 |

OTHER PUBLICATIONS

Karthikeyan, J. et al, "Plasma Spray Synthesis of Nanomaterial Powders and Deposits", Mateirals Science & Engineering A Structural Materials: Properties Microstructure and Processing, Nov. 15, 1997, Elsevier, Switzerland, vol. A238, No. 2, pp. 275-286, XP002250516.
"Synthesis of Nanosized Ceramic Oxide Poweders by Microwave Plasma Reactions", Vollath, D & Sickafus, K., Nanostructured Materials, vol. 1 pp. 427-437, 1992.
English language translation of JP7018076, 13 pages, Jan. 1995.
English language translation of JP8127865, 11 pages, May 1996.
English language translation of JP56166230, 11 pages, Dec. 1981.
English language translation of JP6330326, 11 pages, Feb. 1988.

* cited by examiner

*Primary Examiner*—Marc S Zimmer
(74) *Attorney, Agent, or Firm*—Howard & Howard Attorneys, P.C.

(57) ABSTRACT

A method of forming a gel and/or powder of a metallic oxide, metalloid oxide and/or a mixed oxide or resin thereof from one or more respective organometallic liquid precursor(s) and/or organometalloid liquid precursor(s) by oxidatively treating said liquid in a non-thermal equilibrium plasma discharge and/or an ionised gas stream resulting therefrom and collecting the resulting product. The non-thermal equilibrium plasma is preferably atmospheric plasma glow discharge, continuous low pressure glow discharge plasma, low pressure pulse plasma or direct barrier discharge. The metallic oxides this invention particularly relates to are those in columns 3*a* and 4*a* of the periodic table namely, aluminium, gallium, indium, tin and lead and the transition metals. The metalloids may be selected from boron, silicon, germanium, arsenic, antimony and tellurium. Preferred metalloid oxide products made according to the process of the present invention are in particular oxides of silicon including silicone resins and the like, boron, antimony and germanium.

13 Claims, 4 Drawing Sheets

GEL AND POWDER MAKING

CROSS-REFERENCE TO RELATED APPLICATIONS

This present application is a US national stage filing under 35 USC 371 and claims priority from PCT Application No. PCT/EP03/04344 entitled "GEL AND POWDER MAKING" filed on 8 Apr. 2003, currently pending, which claims priority from Great Britain Patent Application No. 0208263.4 entitled "GEL AND POWDER MAKING" filed on 10 Apr. 2002.

FIELD OF INVENTION

The present application describes a process for making gels and/or powdered material from liquid precursors using non-thermal equilibrium plasma techniques.

BACKGROUND OF THE INVENTION

When matter is continually supplied with energy, its temperature increases and it typically transforms from a solid to a liquid and, then, to a gaseous state. Continuing to supply energy causes the system to undergo yet a further change of state in which neutral atoms or molecules of the gas are broken up by energetic collisions to produce negatively charged electrons, positive or negatively charged ions and other species. This mix of charged particles exhibiting collective behaviour is called "plasma", the fourth state of matter. Due to their electrical charge, plasmas are highly influenced by external electromagnetic fields, which make them readily controllable. Furthermore, their high energy content allows them to achieve processes which are impossible or difficult through the other states of matter, such as by liquid or gas processing.

The term "plasma" covers a huge range of systems whose density and temperature vary by many orders of magnitude. Some plasmas are very hot and all their microscopic species (ions, electrons, etc.) are in approximate thermal equilibrium, the energy input into the system being widely distributed through atomic/molecular level collisions; examples include flame based plasmas. Other plasmas, however, particularly those at low pressure (e.g. 100 Pa) where collisions are relatively infrequent, have their constituent species at widely different temperatures and are called "non-thermal equilibrium" plasmas.

In these non-thermal equilibrium plasmas, the free electrons are very hot with temperatures of many thousands of Kelvin (K) whilst the neutral and ionic species remain cool. Because the free electrons have almost negligible mass, the total system heat content is low and the plasma operates close to room temperature thus allowing the processing of temperature sensitive materials, such as plastics or polymers, without imposing a damaging thermal burden. The hot electrons create, through high energy collisions, a rich source of radicals and excited species with a high chemical potential energy capable of profound chemical and physical reactivity. It is this combination of low temperature operation plus high reactivity which makes non-thermal equilibrium plasma technologically important and a very powerful tool for manufacturing and material processing as it is capable of achieving processes which, if achievable at all without plasma, would require very high temperatures or noxious and aggressive chemicals.

For industrial applications of plasma technology, a convenient method is to couple electromagnetic power into a volume of process gas, which can be mixtures of gases and vapours in which the workpieces/samples to be treated are immersed or passed through. The gas becomes ionised into plasma, generating chemical radicals, UV-radiation, and ions, which react with the surface of the samples. By correct selection of process gas composition, driving power frequency, power coupling mode, pressure and other control parameters, the plasma process can be tailored to the specific application required by a manufacturer.

Because of the huge chemical and thermal range of plasmas, they are suitable for many technological applications. These properties provide a strong motivation for industry to adopt plasma-based processing, and this move has been led since the 1960s by the microelectronics community which has developed low pressure Glow Discharge plasma into an ultra-high technology and high capital cost engineering tool for semiconductor, metal and dielectric processing. The same low pressure Glow Discharge type plasma has increasingly penetrated other industrial sectors since the 1980s offering, at more moderate cost, processes such as polymer surface activation for increased adhesion/bond strength, high quality degreasing/cleaning and the deposition of high performance coatings. Thus, there has been a substantial take-up of plasma technology. Glow discharges can be achieved at both vacuum and atmospheric pressures.

Atmospheric pressure plasmas, however, offer industry open port or perimeter systems providing free ingress into and exit from the plasma region by workpieces/webs and, hence, on-line, continuous processing of large or small area webs or conveyor-carried discrete webs. Throughput is high, reinforced by the high species flux obtained from high pressure operation. Many industrial sectors, such as textiles, packaging, paper, medical, automotive, aerospace, etc., rely almost entirely upon continuous, on-line processing so that open port/perimeter configuration plasmas at atmospheric pressure offer a new industrial processing capability.

Corona and flame (also a plasma) treatment systems have provided industry with a limited form of atmospheric pressure plasma processing capability for about 30 years. However, despite their high manufacturability, these systems have failed to penetrate the market or be taken up by industry to anything like the same extent as the lower pressure, bath-processing-only plasma type. The reason is that corona/flame systems have significant limitations. They operate in ambient air offering a single surface activation process and have a negligible effect on many materials and a weak effect on most. The treatment is often non-uniform and the corona process is incompatible with thick webs or 3D webs while the flame process is incompatible with heat sensitive powdered particles.

Considerable work has been done on the stabilisation of atmospheric pressure glow discharges, such as described in Okazaki et al. J. Phys. D: Appl. Phys. 26 (1993) 889-892.

Further, U.S. Pat. No. 5,414,324 describes the generation of a steady-state glow discharge plasma at atmospheric pressure between a pair of electrically insulated metal plate electrodes spaced up to 5 cm apart and radio frequency (RF) energised with a root means square (rms) potential of 1 to 5 kV at 1 to 100 kHz.

Metal oxides and metalloid oxides are made by a wide variety of processes. Titanium dioxide for example may be made by mixing titanium ores in sulphuric acid to make titanium sulphate, which is then calcined to produce titanium dioxide. Silicon dioxide or titanium dioxide may be prepared by reacting their respective chloride with oxygen at an elevated temperature. In this method, the reactants are brought to reaction temperatures by combusting a flammable gas such as methane or propane.

One of the main problems with the "wet chemistry" type preparations of oxides is that the average particle size of the resulting powder particles tend to be significantly larger than optimally required in many of today's applications for such products.

The use of thermal-equilibrium plasma processes for the production of the oxides of silicon, titanium, aluminium, zirconium, iron and antimony has been described in US 20020192138, which was published after the priority date of the present application, in which a plasma generator producing a temperature of between 3000 and 12000° C. is used to oxidize vapours of salts of the above metals and metalloids.

Many electronics and/or optical based applications exist for metal and metalloid oxides, for example, they may be utilized to enhance the refractive indices of silicone polymers, organic resins and glasses such as by blending $TiO_2$ or $ZrO_2$ with silica or organopolysiloxane or to react silica or silicone/silicate precursors with titanium alkoxides as described in WO 99/19266 or with a $TiO_2$—$ZrO_2$—$SiO_2$—$SnO_2$ composite sol as described in JP 11-310755. However, the refractive index of the final inorganic material is usually lower than theoretically expected either because of the difficulty of preparing nano-sized particles, the inhomogeneity resulting from a broad particles size distribution, the tendency for nanoparticles to self-aggregate resulting to a light scattering effect phenomenon.

Organosilicone resins are generally synthesized by the hydrolysis and subsequent condensation of chlorosilanes, alkoxysilanes and silicates, such as sodium silicate. They are generally described using the M, D, T and Q nomenclature in which M units have the general formula $R_3SiO_{1/2}$, units have the general formula $R_2SiO_{2/2}$, T units have the general formula $RSiO_{3/2}$ and Q units have the general formula $SiO_{4/2}$ where, unless otherwise indicated, each R group is an organic hydrocarbon group, typically a methyl group.

DETAILED DESCRIPTION OF THE INVENTION

In accordance with a first embodiment of the present invention there is provided a method of forming a gel and/or powder of a metallic oxide, metalloid oxide and/or a mixed oxide or resin thereof from one or more respective organometallic liquid precursor(s) and/or organometalloid liquid precursor(s) by oxidatively treating said liquid in a non-thermal equilibrium plasma discharge and/or an ionised gas stream resulting therefrom and collecting the resulting product.

For the purposes of this application a powder is a solid material in the form of spherical particles, pellets, platelets, needles/tubes, flakes, dust, granulates and any aggregates of the aforementioned forms. For the purposes of this application a gel is a typically transparent jelly-like material in the form of a thin film or solidified mass.

Non-thermal equilibrium plasma techniques typically operate at temperatures below 200° C. but preferably the method of the present invention will operate at temperatures between room temperature (20° C.) and 70° C. and is typically utilized at a temperature in the region of 30 to 50 ° C., but will depend on the product to be obtained.

The metals, whose oxides and the like this invention particularly relates, are those of columns 3a and 4a of the periodic table, namely aluminium, gallium, indium, tellurium, tin, lead and the transition metals. Hence, metallic oxide products of the present invention may be either single metal oxides such as, for example, the oxides of titanium, zirconium, iron, aluminum, indium, lead and tin. Mixed oxides include, for example, aluminium silicate, aluminium titanate, lead bisilicate, lead titanate, zinc stannate, $TiO_2$—$ZrO_2$—$SiO_2$—$SnO_2$ and a mixed indium-tin oxide. Proportions of mixed oxides may be determined by the ratios of the amounts of each constituent of the precursor to be plasma treated in the method of the present invention.

A metalloid or semi-metal (hereafter referred to as a metalloid) is an element having both metallic and non-metallic properties and is selected from boron, silicon, germanium, arsenic, antimony and tellurium. Preferred metalloid oxide products made according to the process of the present invention are in particular oxides of silicon including silicone resins and the like, boron, antimony and germanium. In particular a silicone resin having the following empirical formula:

$$(R'''_3SiO_{1/2})_w(R'''_2SiO_{2/2})_x(R'''SiO_{3/2})_p(SiO_{4/2})_z$$

where each R''' is independently an alkyl, alkenyl, aryl, H, OH, and wherein $w+x+p+z=1$ and $w<0.9$, $x<0.9$, $p+z>0.1$ may be formed by the process in accordance with the present invention.

Thus in the method of the present invention it is particularly preferred to use organometallic liquid precursors of the above listed metals and/or organometalloid liquid precursors of the above listed metalloids. One of the main advantages of the present invention is that no solvent is usually required and preferably no solvent is used at all, i.e. the organometallic and/or organometalloid liquid precursors used in the method of the present invention are solvent-free.

Preferably in the case of organometallic based precursors, the precursor may contain any suitable oxidisable groups including chlorides, hydrides, diketonates, carboxylates and mixed oxidisable groups for example, di-t-butoxydiacetoxysilane or titanium dichloro diethoxide, titanium diisopropoxide bis(ethyl-acetoacetate) or titanium diisopropoxide bis (tetramethylheptanedionate), but liquid metal alkoxides are particularly preferred. Liquid metal alkoxides suitable for use as precursors in the present invention may, for example, have the following general formula:

$$M(OR')_y,$$

where M is a metal, y is the number of alkoxide groups linked to the metal and each R' is the same or different and is a linear or branched alkyl group having between 1 and 10 carbon atoms such as, for example, methyl, ethyl, propyl, isopropyl, butyl, t-butyl, pentyl and hexyl. Examples of suitable metal alkoxides include, for example, titanium isopropoxide, tin t-butoxide and aluminium ethoxide. Mixed metallic alkoxides may also be used as liquid precursors, for example indium-tin alkoxides, aluminum titanium alkoxides, aluminum yttrium alkoxides, and aluminum zirconium alkoxides. Metallic-metalloid mixed alkoxides may also be utilized such as for example di-s-butoxyaluminoxytriethoxysilane.

Similarly organometalloid liquid precursors may contain any suitable groups, which will oxidize in an oxidising non-thermal equilibrium plasma to form the respective oxide, and in particular, in the case of silicon, to form silicon resins. Examples of suitable metalloid alkoxides include silicon tetramethoxide and germanium tetraisopropoxide. It is to be understood that the term organometalloid liquid as used herein includes polymers of organometalloid elements and in particular in the case of silicon may include liquid organosilanes such as, for example diphenylsilane and dialkylsilanes, e.g. diethylsilane and/or linear, branched and/or cyclic organopolysiloxanes for the formation of silica and silicates (silicone resins).

The level of transformation of the liquid precursor from the liquid phase to a gel and to powder depends on the plasma treatment time in a batch process or residence time in a continuous process.

The linear or branched organopolysiloxanes suitable as liquid precursors for the method of the present invention include liquids of the general formula W-A-W where A is a polydiorganosiloxane chain having siloxane units of the formula $R''_sSiO_{4-s/2}$ in which each R" independently represents an alkyl group having from 1 to 10 carbon atoms, an alkenyl group such as vinyl, propenyl and/or hexenyl groups; hydrogen; an aryl group such as phenyl, a halide group, an alkoxy group, an epoxy group, an acryloxy group, an alkylacryloxy group or a fluorinated alkyl group and generally s has a value of 2 but may in some instances be 0 or 1. Preferred materials are linear materials i.e. s=2 for all units. Preferred materials have polydiorganosiloxane chains according to the general formula $—(R''_2SiO)_m—$ in which each R" is independently as hereinbefore described and m has a value from about 1 to about 4000. Suitable materials have viscosities of the order of about 0.65 mPa·s to about 1,000,000 mPa·s. When high viscosity materials are used, they can be diluted in suitable solvents to allow delivery of liquid precursor in the form of a finely dispersed atomised spray, or fine droplets, although as previously discussed, it is preferred to avoid the need for solvents if at all possible. Most preferably, the viscosity of the liquid precursor is in the range between about 0.65 mPa·s and 1000 mPa·s and may include mixtures of linear or branched organopolysiloxanes as hereinbefore described suitable as liquid precursors.

The groups W may be the same or different. The W groups may be selected, for example, from $—Si(R'')_2X$, or $$—Si(R'')_2—(B)_d—R'''SiR''_k(X)_{3-k}$$

where B is $—R'''—(Si(R'')_2—O)_r—Si(R'')_2—$ and R" is as aforesaid, R''' is a divalent hydrocarbon group r is zero a whole number between 1 and 6 and d is 0 or a whole number, most preferably d is 0, 1 or 2, X may be the same as R" or a hydrolysable group such as an alkoxy group containing alkyl groups having up to 6 carbon atoms, an epoxy group or a methacryloxy group or a halide.

Cyclic organopolysiloxanes having the general formula $(R''_2SiO_{2/2})_n$ wherein R" is hereinbefore described, n is from 3 to 100 but is preferably from 3 to 22, most preferably n is from 3 to 6. Liquid precursors may comprise mixtures of cyclic organopolysiloxanes as hereinbefore defined.

The liquid precursor may also comprise mixtures comprising one or more of the linear or branched organopolysiloxanes as hereinbefore described with one or more of the cyclic organopolysiloxanes as hereinbefore described.

The average particle size of the particles formed is preferably from 1 nm (nanometer) to 2000 μm (or micron), preferably between 10 nm and 250 μm.

The liquid precursor may be brought into contact with the plasma discharge and an ionised gas stream resulting therefrom by any suitable means. In a preferred embodiment the liquid precursor is preferably introduced into the plasma apparatus by way of a liquid spray through an atomiser or nebuliser (hereinafter referred to as an atomiser) as described in the applicants co-pending application WO 02/28548, which was published after the priority date of this application. This provides the invention with a major advantage over the prior art in that the liquid precursor may be introduced into the plasma discharge or resulting stream in the absence of a carrier gas, i.e. they can be introduced directly by, for example, direct injection, whereby the liquid precursors are injected directly into the plasma. Hence, the inventors avoid the need for the essential features of US 20020192138 which as discussed above requires both very high working temperatures and the need for the salts to be in a vaporous form.

In the case when the liquid precursor is introduced into the plasma apparatus by way of a liquid spray through an atomiser or nebuliser, said liquid precursor may be atomised using any conventional means, for example an ultrasonic nozzle. The atomiser preferably produces a liquid precursor drop size of from 10 nm to 100 μm, more preferably from 1 μm to 50 μm. Suitable for use in the method in accordance with the present invention are ultrasonic nozzles from Sono-Tek Corporation, Milton, N.Y., USA or Lechler GmbH of Metzingen Germany.

The liquid precursor may alternatively be entrained on a carrier gas or transported in a vortex or dual cyclone type apparatus, in which case the liquid to be treated may be fed in from one or more inlets within the plasma apparatus. The liquid may also be suspended in a fluid bed arrangement within the plasma apparatus. Furthermore, the liquid precursor may be maintained stationary in a suitable receptacle, in which case, if required, the plasma unit generating the plasma discharge and/or an ionised gas stream may be moved relative to the receptacle. Whichever means of transporting and/or retaining the liquid precursor is utilized, it is preferred that the exposure time in which liquid precursor remains within the plasma discharge and an ionised gas stream is constant in order to ensure an even treatment throughout the duration of the method in accordance with the present invention.

Any suitable non-thermal equilibrium plasma equipment may be used to undertake the method of the present invention, however atmospheric pressure glow discharge, dielectric barrier discharge (DBD), low pressure glow discharge, which may be operated in either continuous mode or pulse mode.

Any conventional means for generating an atmospheric pressure glow discharge may be used in the method of the present invention, for example atmospheric pressure plasma jet, atmospheric pressure microwave glow discharge and atmospheric pressure glow discharge. Typically, such means will employ helium as a process gas and a high frequency (e.g.>1 kHz) power supply to generate a homogeneous glow discharge at atmospheric pressure via a Penning ionisation mechanism, (see for example, Kanazawa et al, J. Phys. D: Appl. Phys. 1988, 21, 838, Okazaki et al, Proc. Jpn. Symp. Plasma Chem. 1989, 2, 95, Kanazawa et al, Nuclear Instruments and Methods in Physical Research 1989, B37/38, 842, and Yokoyama et al., J. Phys. D: Appl. Phys. 1990, 23, 374).

A typical atmospheric pressure glow discharge generating apparatus for use in the method of the present invention may include at least one or more pairs of parallel or concentric electrodes between which a plasma is generated in a substantially constant gap of from 3 mm to 50 mm, for example 5 mm to 25 mm between the electrodes or more preferably between dielectric coatings on the electrodes. The actual distance between adjacent parallel electrodes used, whilst up to a maximum of 50 mm is dependent on the process gas used. The electrodes being radio frequency (RF) energised with a root mean square (rms) potential of 1 kV to 100 kV, preferably between 1 kV and 30 kV and most preferably between 2.5 kV and 10 kV, however the actual value will depend on the chemistry and gas choice and plasma region size between the electrodes. The frequency is generally between from 1 kHz to 100 kHz, preferably at least 15 kHz to 50 kHz.

The process gas for use in an atmospheric plasma treatment method in accordance with the present invention may be any suitable gas but is preferably a noble gas or noble gas based mixture such as, for example helium, a mixture of helium and argon and an argon based mixture additionally containing ketones and/or related compounds. In the present invention these process gases are utilized in combination with one or more potentially reactive gases suitable for affecting the required oxidation of the liquid precursor such as, for example, O2, $H_2O$, nitrogen oxides such as $NO_2$, or air and the like. Most preferably, the process gas will be Helium in combination with an oxidizing gas, typically oxygen or air. However, the selection of gas depends upon the plasma processes to be undertaken. The oxidizing gas will preferably be utilized in a mixture comprising 90-99% noble gas and 1 to 10% oxidizing gas.

In the case of low pressure glow discharge plasma, liquid precursor is preferably either retained in a container or is introduced into the reactor in the form of an atomised liquid spray as described above. The low pressure plasma may be performed with liquid precursor heating and/or pulsing of the plasma discharge, but is preferably carried out without the need for additional heating. If heating is required, the method in accordance with the present invention using low pressure plasma techniques may be cyclic, i.e. the liquid precursor is plasma treated with no heating, followed by heating with no plasma treatment, etc., or may be simultaneous, i.e. liquid precursor heating and plasma treatment occurring together. The plasma may be generated by way of the electromagnetic radiations from any suitable source, such as radio frequency, microwave or direct current (DC). A radio frequency (RF) range between 8 MHz and 16 MHz is suitable with an RF of 13.56 MHz preferred. In the case of low pressure glow discharge any suitable reaction chamber may be utilized. The power of the electrode system may be between 1 W and 100 W, but preferably is in the region of from 5 W to 50 W for continuous low pressure plasma techniques. The chamber pressure may be reduced to any suitable pressure for example from 0.1 mbar to 0.001 mbar but preferably is between 0.05 mbar and 0.01 mbar.

A particularly preferred plasma treatment process involves pulsing the plasma discharge at room temperature. The plasma discharge is pulsed to have a particular "on" time and "off" time, such that a very low average power is applied, for example a power of less than 10 W and preferably less than 1 W. The on-time is typically from 10 μs to 10000 μs, preferably 10 μs to 1000 μs, and the off-time typically from 1000 μs to 10000 μs, preferably from 1000 μs to 5000 μs. Atomized liquid precursors may be introduced into the vacuum with no additional gases, i.e. by direct injection, however additional process gases such as helium or argon may also be utilized as carriers where deemed necessary.

In the case of the low pressure plasma options the process gas for forming the plasma may be as described for the atmospheric pressure system but may alternatively not comprise noble gases such as helium and/or argon and may therefore purely be oxygen, air or an alternative oxidising gas.

The gel and/or powder products of the present invention may subsequently be treated as required, using plasma techniques or otherwise, by any suitable process. In particular products made by the present invention may be cleaned and/or activated or coated, for example, by application of a liquid or solid spray through an atomiser or nebuliser as described in the applicants co-pending application WO 02/28548, which was published after the priority date of this application.

The present invention further provides apparatus for making a gel and/or powder in accordance with the previous aspect of the present invention, which apparatus comprises a non-equilibrium plasma apparatus comprising a means for introducing and/or retaining a liquid precursor and a means for collecting and/or retaining the resulting gel and/or powder product.

The means for retaining the liquid precursor and the means for retaining the gel and/or powder product may be the same.

In the case of an atmospheric plasma apparatus, the plasma apparatus may be orientated vertically, allowing the liquid precursor to be gravity fed. For example, if atmospheric pressure glow discharge is employed, using either flat, parallel electrodes, or concentric parallel electrodes, the electrodes may be orientated vertically. In this case, liquid precursor to be treated may be transported through the plasma region in an upwardly or downwardly direction. The liquid precursor is preferably introduced at the top of the plasma apparatus and passes through the plasma region, where oxidation and the formation of the oxide based powder products in accordance with the method of the present invention are formed. The resulting powdered product may then exit the chamber at the base. The liquid precursor residence time in the plasma region may be predetermined to be as required for the successful formation of a powder, alternatively the path length of the liquid precursor through the plasma region may be altered as required.

In the case of atmospheric pressure plasma assemblies each electrode may comprise any suitable geometry and construction. Metal electrodes may be used and may be in, for example, the form of metallic plates or mesh. The metal electrodes may be bonded to the dielectric material either by adhesive or by some application of heat and fusion of the metal of the electrode to the dielectric material. Alternatively one or more of the electrodes may be encapsulated within the dielectric material or may be in the form of a dielectric material with a metallic coating such as, for example a dielectric, preferably a glass dielectric with a sputtered metallic coating.

In one embodiment of the invention each electrode is of the type described in the applicants co-pending application WO 02/35576 which was published after the priority date of the present invention wherein there are provided electrode units containing an electrode and an adjacent dielectric plate and a cooling liquid distribution system for directing a cooling conductive liquid onto the exterior of the electrode to cover a planar face of the electrode. Each electrode unit may comprise a watertight box having a side formed by a dielectric plate having bonded thereto on the interior of the box the planar electrode together with a liquid inlet and a liquid outlet. The liquid distribution system may comprise a cooler and a recirculation pump and/or a sparge pipe incorporating spray nozzles.

Ideally, the cooling liquid covers the face of the electrode remote from the dielectric plate. The cooling conductive liquid is preferably water and may contain conductivity controlling compounds such as metal salts or soluble organic additives. Ideally, the electrode is a metal electrode in contact with the dielectric plate. In one embodiment, there is a pair of metal electrodes each in contact with a dielectric plate. The water as well as being an extremely efficient cooling agent to also assists in providing an efficient electrode.

The dielectric materials may be made from any suitable dielectric, examples include but are not restricted to polycarbonate, polyethylene, glass, glass laminates, epoxy filled glass laminates and the like.

In one embodiment of the invention a statically electric charged porous plate or a vibrating sieve may be placed in line with the exit of the powdered particles from the plasma region to collect the resulting powdered particles.

One particular advantage of the present invention is that the inventors have been able to prepare silicone resins as described above by way of a single step method from polymeric liquid precursors rather than from the usual monomeric precursors. The silicone resins contain high levels of T and or Q siloxy units and may be in the form of gels and/or powder. Depending on the molecular structures of the liquid precursors, incorporation of M and/or D siloxy units may be undertaken. Typically such resins are prepared by the hydrolysis and subsequent condensation of monomeric and/or polymeric precursors such as chlorosilanes, alkoxysilanes or sodium silicates.

A further perceived advantage is that the particle size of the powder made in accordance with the method of the present invention are generally in the nanometre size range (nanoparticles). Hence, powdered particles produced by the method of the present invention may have various utilities, for example they may be useful in the fields of optoelectronics, photonics, solid-state electronics, flexible electronics, optical devices flat panel displays and solar cells. Silicone resins made by the method of the present invention may be used as high performance composites, fire resistant materials, electrically and/or thermally insulation coatings for example for the microelectronic industry, optically clear coatings and high refractive index coatings for example for the display industry in applications such as televisions, flat panel displays, for the ophthalmic industry in applications such as ophthalmic lenses. Indium-tin mixed oxides are used as electrodes for transparent electrically conductive films and flat panel displays.

FIGURES

The present invention will now be described further based on the following examples and drawings in which.

Figure 3A:
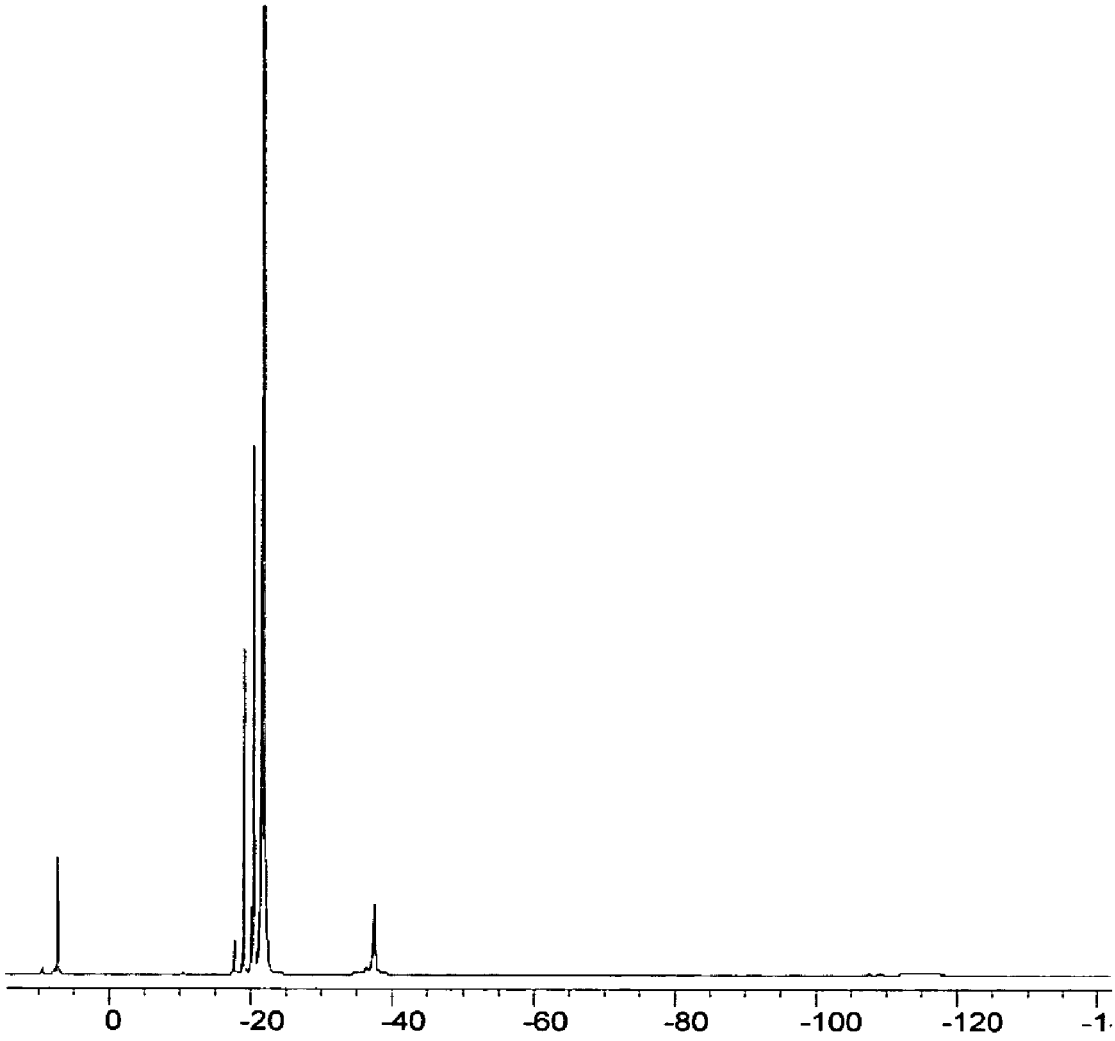
Figure 3B:
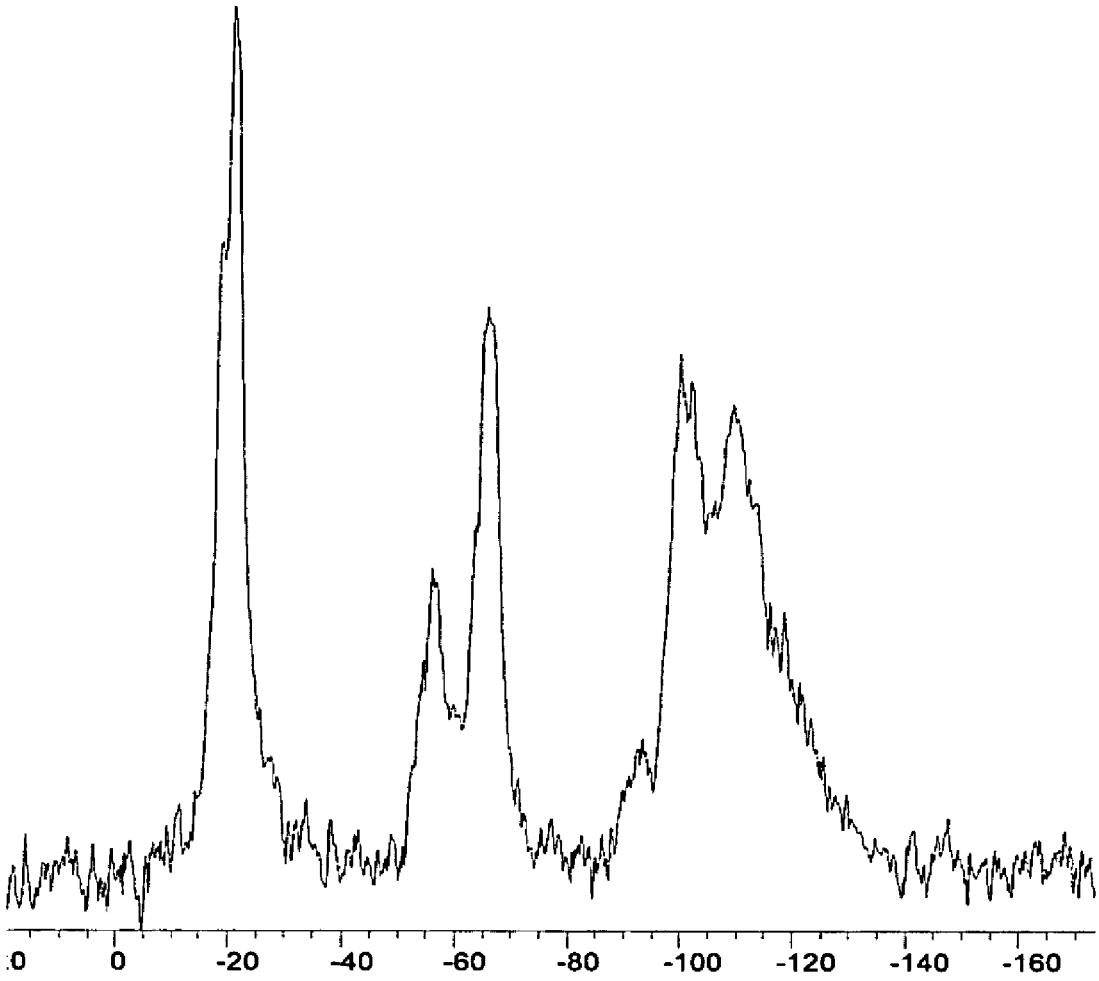

FIG. 3*a* is a $^{29}$Si liquid-state NMR spectrum by the CP-MAS method of the liquid precursor used in Example 5; and FIG. 3*b* is a $^{29}$Si solid-state NMR spectrum by the CP-MAS method of the powdered product in Example 5.

Figure 1:
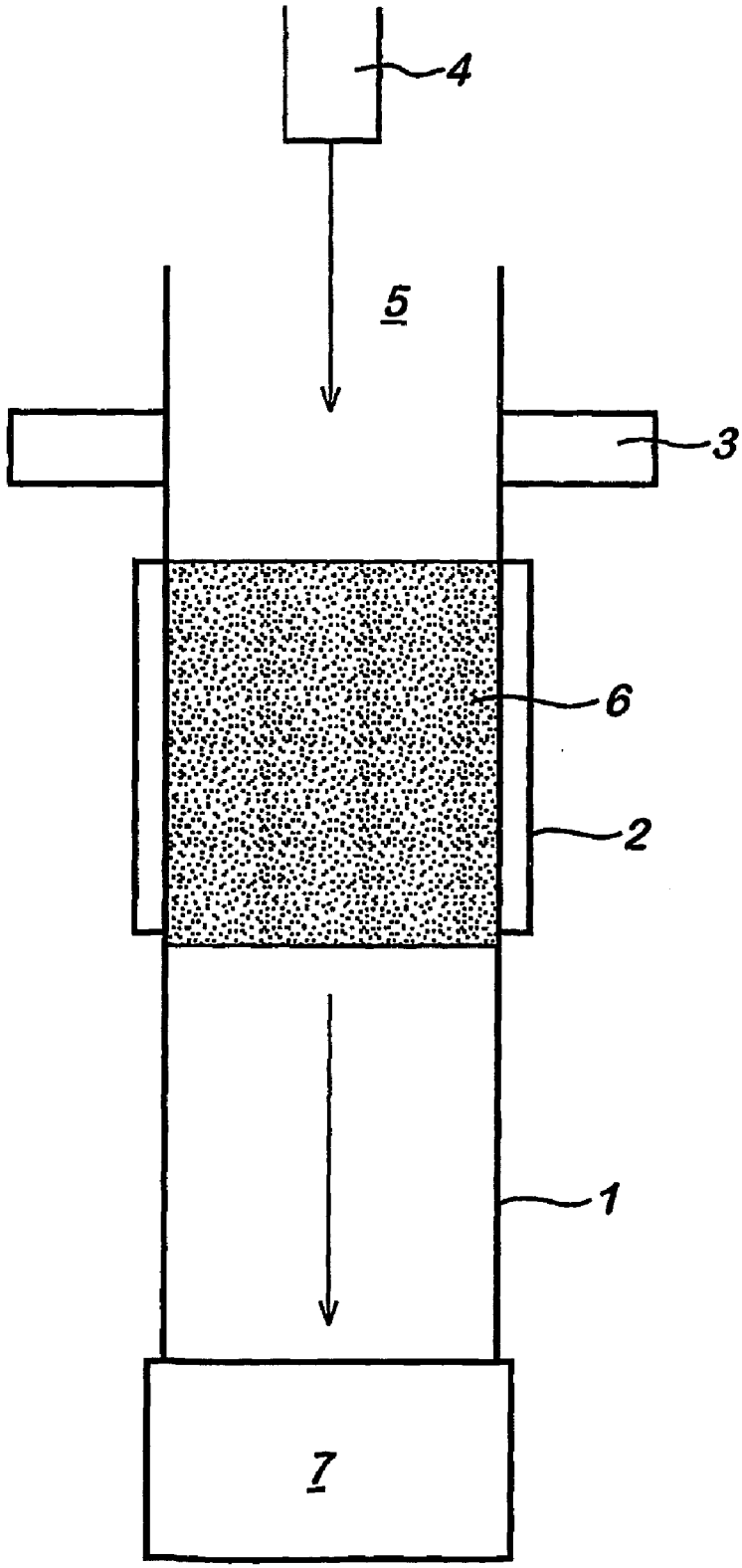
FIG. 1 shows a plan view of an embodiment of the invention where the powdered particles are transported through the plasma region by gravity.

In a first embodiment as shown in FIG. 1 there is provided an atmospheric pressure glow discharge apparatus for making powdered particles which relies upon gravity for transport of the liquid precursors and synthesised powdered particles through the atmospheric pressure glow discharge apparatus. The apparatus comprises a casing made of a dielectric material such as polypropylene, a pair of parallel electrodes 2 and an atomiser nozzle 3 for the introduction of the liquid precursor. In use, a process gas, typically helium in combination with an oxidising gas, for example oxygen, is introduced into the top of the column 5 from delivery means 4 and an appropriate potential difference is applied between the electrodes to affect a plasma therebetween as identified by the plasma region 6. Appropriate amounts of the liquid precursor are introduced by way of nozzle 3 into plasma region 6. The liquid precursor and subsequently formed powder product fall under gravity through plasma zone 6 and are collected upon exiting the apparatus in collecting means 7.

EXAMPLE 1

This example utilises the atmospheric pressure glow discharge equipment described above in relation to FIG. 1. The atmospheric pressure glow discharge was generated by applying RF power of 1 W/cm$^2$ to two electrodes adhered to glass plates that enclose a helium/oxygen gas mixture in the ratio of 98/2. Tetramethylcyclotetrasiloxane (TMCTS) was supplied to an ultrasonic nozzle at a flow rate of 200 microliters per minute. TMCTS droplets were discharged from the ultrasonic nozzle above the atmospheric pressure glow discharge. These TMCTS droplets pass through the atmospheric pressure glow discharge and form a fine white powder which was collected below the atmospheric pressure glow discharge. The white powder prepared during the method as described in example 1 was analysed by $^{29}$Si solid-state NMR using a Cross Polarisation Magic Angle Spinning process with a speed of 5 KHz, Cross polarisation time of 5 ms and Pulse delay of 5 secs.

Figure 2:
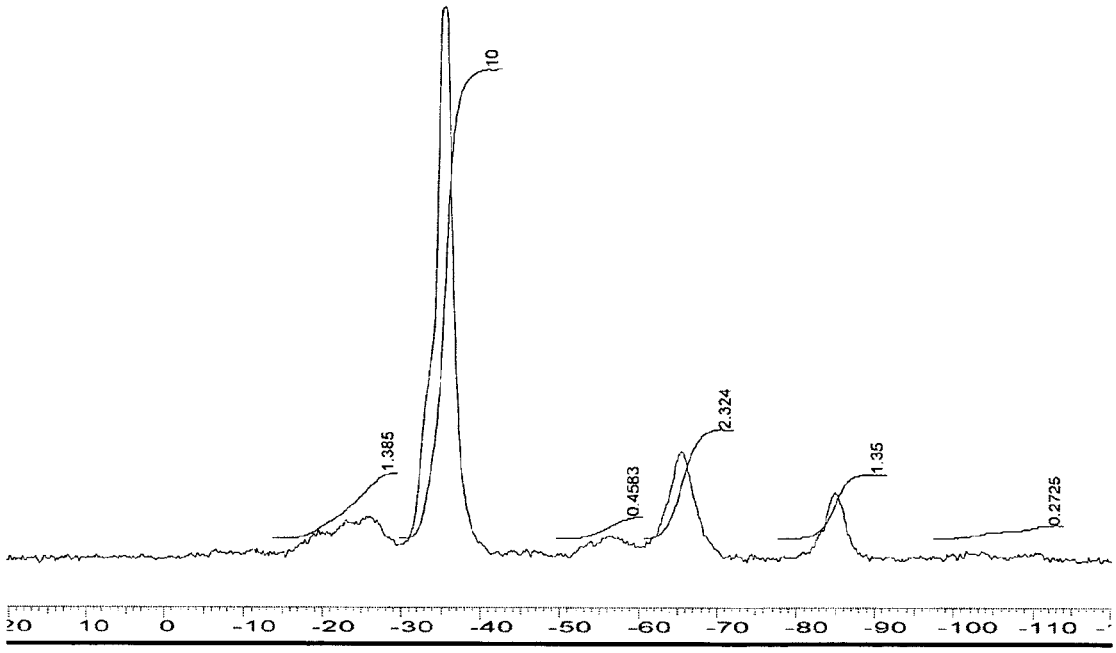
FIG. 2 is a $^{29}$Si solid-state NMR spectrum by the cross-polarisation-magic angle spinning (CP-MAS) method of the silicone resin product prepared in Example 1.

FIG. 2 shows the $^{29}$Si NMR CP-MAS spectrum of the white powder formed in APGD and indicates that the TMCTS has been oxidised and condensed into a polymeric form. The spectra was assigned as follows:

| Chemical Shift | Assignment |
|---|---|
| −15 to −30 | In the region associated with $Me_2SiO_{2/2}$ (D units) |
| −30 to −40 | $MeHSiO_{2/2}$ ($D^H$ units) |
| −50 to −60 | $MeSiO_{2/2}OR$ ($D^{OR}$ where R = H or an aliphatic group) |
| −60 to −70 | $MeSiO_{3/2}$ (T units) |
| −80 to −90 | $HSiO_{3/2}$ ($T^H$ units) |
| −95 to −115 | $SiO_{3/2}OH$ and silica $SiO_{4/2}$ (Q3 and Q4 groups respectively) |

Examples 2 to 7 all describe examples using a continuous low pressure glow discharge plasma system. The plasma apparatus used in this study was a radio frequency (10 MHz-12 MHz) model PDC-002 (Harrick Scientific Corp., Ossining, N.Y., USA.) The chamber volume was 3000 cm$^3$. Examples 2 to 7 were all carried out using the same procedure. Initially, the plasma apparatus was pumped down to a base pressure of 0.008 mbar. The process gas was introduced into the chamber to a pressure of 0.2 mbar for two minutes, and the plasma activated for 10 minutes at this pressure at high power to thoroughly clean the chamber. The plasma was then deactivated, and the chamber flushed with process gas for a further two minutes. The chamber was then vented, the sample was inserted retained in a petri dish and the chamber was pumped down to 0.008 mbar. Process gas was then introduced at a pressure of 0.2 mbar, and the plasma activated for the required time using the low power setting of 7.2 W. The chamber was then vented to air prior to surface analysis of the samples.

EXAMPLE 2

A trimethylsilyl-terminated-polydimethylsiloxane (TMS-t-PDMS) hereafter called PDMS fluid, having a viscosity of 100 mPa·s and an average degree of polymerisation of 80, was introduced in a low pressure glow discharge nitrogen/oxygen (79/21 synthetic air) plasma reactor. The PDMS fluid (2 ml) was placed in a petri dish to increase the surface/volume ratio and was treated as described above. After an initial plasma treatment the surface of the PDMS fluid was transformed into a polysiloxane resinous material in a gel form. Increasing the plasma treatment time led to the transformation of the fluid to a resin in a powder form.

The final duration of the plasma treatment was 20 minutes. Part of the fluid was transformed into a resinous material. The resinous material was separated from the liquid material. The liquid material was analysed by liquid-state $^{29}$silicon NMR. The formation of both silanol groups at the end of and within the PDMS fluid polymeric chains and new Si—O—Si linkages in strained polycyclic structures was demonstrated.

Analysis of the resinous material showed exactly the same groups formed e.g. silanol and polycyclic structures as compared to the liquid fraction but at higher concentration.

The $^{29}$Si chemical shifts were −10.5 ppm for terminal silanol ($M^{OH}$), −53.1 ppm for silanol ($D^{OH}$), −55.0 to −61.0 for siloxane cyclics (T). In addition a signal attributed to Si—$CH_2$—Si linkage was identified at −29.1 ppm. These analytical data, suggest the following mechanisms of formation of the resinous powder material. Si—OH groups are first formed and then chemically condense to form Si—O—Si linkages that are the basis of the resinous chemical structure. Additionally Si—$CH_2$—Si crosslinks are also formed. Hence the NMR results indicate that plasma treatment in accordance with the present invention has modified the chemical structure of the PDMS fluid starting material resulting in the formation of an organosilicone resin comprising mainly D and T siloxy groups.

EXAMPLE 3

A PDMS fluid having a viscosity of 50 mPa·s and an average degree of polymerisation of 50 was introduced in to a low-pressure glow discharge oxygen (99.9995%) plasma reactor. The PDMS fluid (2 ml) was placed in a petri dish to increase the surface/volume ratio. The surface of the PDMS fluid was transformed into an organosilicone resin upon plasma treatment for a period of 10 minutes. The quantity of organosilicone resin was increased by intermittently switching off the plasma and by mixing the product under plasma treatment.

The resinous material was analysed by FT-InfraRed spectroscopy and was identified to have silicone resin structure. $^{29}$Si solid-state NMR confirmed the organosilicone resin structure as composed of largely D, $D^{OH}$ and T siloxy units.

EXAMPLE 4

A PDMS fluid having a viscosity of 20 mPa·s and an average degree of polymerisation of 27 was introduced in a low pressure glow discharge nitrogen/oxygen (79/21 synthetic air) plasma reactor. The PDMS fluid (2 ml) was placed in a petri dish to increase the surface /volume ratio. The surface of the PDMS fluid was transformed into a organosilicone resin upon plasma treatment during 20 minutes. The quantity of organosilicone resin was increased by intermittently switching off the plasma and by mixing the product under plasma treatment.

The resulting organosilicone resin was separated from the liquid. The liquid material was analysed by $^{29}$Si liquid-state NMR. The formation of both silanol groups at the end of and within the PDMS fluid polymeric chains and new Si—O—Si linkages in strained polycyclic structures was identified. Analysis of the organosilicone resin showed exactly the same groups formed e.g. silanol and polycyclic structures but at higher concentration. The $^{29}$Si solid-state NMR chemical shifts were −10.7 ppm for terminal silanol ($M^{OH}$), −53.1 ppm for silanol ($D^{OH}$) and −55.0 to −61.0 for siloxane cyclics (T). Again the $^{29}$Si solid-state NMR results indicated that the process in accordance with the present invention has modified the chemical structure of the PDMS fluid. The organosilicone resin had a structure which mainly consisted of D and T groups.

EXAMPLE 5

A trimethylsilyl-terminated-polydimethyl-co-hydrogenmethylsiloxane (TMS-t-PDM-HMS) hereafter called silicone fluid having a viscosity of 100 mPa·s, an average degree of polymerisation of 90 and containing 5% of hydrogen methyl siloxy units, was introduced in a low pressure glow discharge oxygen (99.9995%) plasma reactor. A $^{29}$Si solid-state NMR spectra of the silicone fluid liquid precursor is provided as FIG. 3*a* in which can be seen signals show the M terminal groups at +7 ppm, D groups at −22 ppm and $D^H$ groups at −38 ppm. It is to be noted that no signals are seen in the −50 to −120 ppm range.

The silicone fluid (2 ml) was placed in a petri dish to increase the surface /volume ratio. The surface of the silicone fluid was transformed into an organosilicone resin upon plasma treatment and a white powder was collected on the wall of the chamber. During the formation of the resin and the powder the intensity of plasma glow increased without changing colour. Increasing plasma treatment time increased white powder content.

The white powder and the resinous material were separated from the liquid material. The liquid material was analysed by $^{29}$Si liquid-state NMR. Again the formation of silanol groups at the end of and within the silicone fluid polymeric chains and of new Si—O—Si linkages in strained polycyclic structures was demonstrated. $^{29}$Si solid-state NMR analysis of the resinous material as seen in FIG. 3*b* showed exactly the same groups formed e.g. silanol and polycyclic structures as compared to the liquid fraction but at higher concentration. It can be seen in FIG. 3*b* that the terminal M and $D^H$ groups seen in FIG. 3*a* have been chemically transformed into new groups appearing in the region of −50 to −120 ppm range.

The $^{29}$Si solid-state NMR chemical shifts were −10.7 ppm for terminal silanol ($M^{OH}$), −53.1 ppm for silanol ($D^{OH}$), −55.0 to −61.0 for siloxane cyclics (T). In addition a signal attributed to Si—$CH_2$—Si linkage was identified at −29.1 ppm. The white powder was analysed by solid-state $^{29}$Si NMR at magic angle spinning and gate decoupling mode to obtain a semi-quantitative analysis of the chemical structure. The white powder was found to be an organosilicone resin having the following structure:

$$D_{0.24}\text{-}D^{OH}_{0.08}\text{-}T^3_{0.16}\text{-}Q^2_{0.03}\text{-}Q^3_{0.20}\text{-}Q^4_{0.29}$$

Where D is $(CH_3)_2SiO_{2/2}$, $D^{OH}$ is $(CH_3)SiO_{2/2}(OH)$, $T^3$ is $(CH_3)SiO_{3/2}$ $Q^2$ is $SiO_{2/2}(OH)_2$, $Q^3$ is $SiO_{3/2}(OH)$ and $Q^4$ is $SiO_{4/2}$.

Particles Size analysis of the white organosilicone resin powder was undertaken using a Coulter LS 230 Laser Particles Size Analyser (from 0.04 to 2000 μm), in water, using the Mie theory and the glass optical model calculation for a fluid corresponding to water (RI 1.332) and sample corresponding to glass (real 1.5 RI, imaginary 0). The particle size distribution of these organosilicone resin is polydispersed and centred (50% in volume) at a particle diameter of below 400 nm.

EXAMPLE 6

Silicone resin from SiH copolymer 100 mPa·s in oxygen plasma and in controlled atmosphere exposure.

In example 5, the resinous and powdery products formed after plasma treatment of the trimethylsilyl-terminated-polydimethyl-co-hydrogenmethylsiloxane (TMS-t-PDM-HMS) polymer was exposed to open laboratory atmosphere before chemical structural analysis. In this example, the experiments were conducted in a glove box under a controlled atmosphere of pure nitrogen. The oxygen level was kept under 50 ppm and moisture was controlled by the purity of the nitrogen gas. The surface of silicone fluid was transformed in to a polysiloxane resinous material upon plasma treatment and a white powder was collected on the wall of the chamber. During the formation of the resin and the powder the intensity of plasma glow increased without changing colour. Increasing plasma treatment time increased white powder content. Immediately after plasma treatment, the resinous product was transferred into an NMR tube under a controlled atmosphere in which no contact with atmospheric oxygen or moisture was possible.

The white powder and the resinous material were separated from the liquid material. The liquid material was analysed by $^{29}$Si liquid-state NMR. The formation of both silanol groups at the end of and within the PDMS polymeric chains and of new Si—O—Si linkages in strained polycyclic structures were both again demonstrated. Analysis of the resinous material by $^{29}$Si solid-state NMR showed that exactly the same groups were present, e.g. silanol and polycyclic structures, as compared to the liquid fraction but at higher concentration levels. The $^{29}$Si solid-state NMR were −10.7 ppm for terminal silanol ($M^{OH}$), −53.1 ppm for silanol ($D^{OH}$), −55.0 to −61.0 for siloxane cyclics (T). In addition a signal attributed to Si—CH2—Si group was identified at −29.1 ppm. The white powder was analysed by $^{29}$Si solid-state NMR at magic angle spinning and gate decoupling mode to obtain a semi-quantitative analysis of the chemical structure.

The general structure of the resinous material was identical to the material that was formed and exposed to open laboratory, detailed in example 5. NMR results indicated that plasma irradiation had modified the chemical structure of the silicone fluid.

Particles Size analysis of the white organosilicone resin powder was undertaken using a Coulter LS 230 Laser Particles Size Analyser (from 0.04 μm to 2000 μm), in water, using the Mie theory and the standard Fraunhofer optical model calculation. The particle size distribution of these organosilicone resin is polydispersed and centred (50% in volume) at a particle diameter of below 120 μm.

EXAMPLE 7

In example 4, the resinous product formed after plasma treatment of the PDMS fluid was exposed to the open atmosphere in the laboratory before chemical structural analysis. In this example, the experiments were conducted in a glove box under a controlled atmosphere of pure nitrogen. The oxygen level was maintained below 50 ppm and moisture was controlled by the purity of the nitrogen gas. The surface of the silicone fluid was transformed in to a polysiloxane resinous material upon plasma treatment and a white powder was collected on the wall of the chamber. Increasing plasma treatment time increased white powder content. Immediately after plasma treatment, the resinous product was transferred into an NMR tube under a controlled atmosphere in which no contact with atmospheric oxygen or moisture was possible.

The resinous material were separated from the liquid material. The liquid material was analysed by $^{29}$Si liquid-state NMR. The formation of both silanol groups at the end of and within the PDMS polymeric chains and the formation of new Si—O—Si linkages in strained polycyclic structures were demonstrated. Analysis of the resinous material by $^{29}$Si solid-state NMR showed exactly the same groups formed e.g. silanol and polycyclic structures as compared to the liquid fraction but at higher levels of concentration. The $^{29}$Si solid-state NMR chemical shifts were −10.7 ppm for terminal silanol ($M^{OH}$), −53.1 ppm for silanol ($D^{OH}$), −55.0 to −61.0 for siloxane cyclics (T). In addition a signal attributed to Si—$CH_2$—Si group was identified at −29.1 ppm. The white powder was analysed by $^{29}$Si solid-state NMR in a magic angle spinning and gate decoupling mode to obtain a semi-quantitative analysis of the chemical structure. The white powder was found to be an organosilicone resin.

The general structure of the resinous material was identical to the material that was formed and exposed to open laboratory, detailed in example 4. NMR results indicated that plasma irradiation had modified the chemical structure of the PDMS fluid.

EXAMPLE 8

A trimethylsilyl-terminated-polydimethyl-co-hydrogenmethylsiloxane (TMS-t-PDM-HMS) hereafter called silicone fluid having a viscosity of 33 mPa·s, an average degree of polymerisation of 60 and containing 70% of hydrogen methyl siloxy units, was introduced in a low pressure glow discharge oxygen (99.9995%) plasma reactor.

The silicone fluid (2 ml) was placed in a petri dish to increase the surface /volume ratio. Upon plasma treatment lasting 15 minutes a white powder was collected on the wall of the chamber.

The white powder was analysed by $^{29}$Si solid-state NMR with a cross-polarisation magic angle spinning and magic angle spinning inverse gated decoupling modes to obtain a qualitative and semi-quantitative analyses of the chemical structure. The siloxy units were identified through the chemical shifts of the peak signals measured in ppm and referenced to tetramethylsilane. The signals were attributed to the following siloxy units forming the powder: M (8.6 ppm), D (−20 ppm), $D^{OH}$ or $T^2$ (−56 ppm), $T^3$ (−65.0), Q2, $Q^3$, $Q^4$ (−85 to 115 ppm). The white powder was found to be an MDTQ organosilicone resin also referred to as an organopolysilicate having the following detailed structure:

$$M_{0.02}\text{-}D_{0.16}\text{-}D^{H}_{0.03}\text{-}D^{OH}_{0.19}\text{-}T^{3}_{0.18}\text{-}Q^{2}_{0.04}\text{-}Q^{3}_{0.18}\text{-}Q^{4}_{0.20}$$

Where M is $(CH_3)_3SiO_{1/2}$, D is $(CH_3)_2SiO_{2/2}$, $D^H$ is $(CH_3)(H)SiO_{2/2}$, $D^{OH}$ is $(CH_3)SiO_{2/2}(OH)$, $T^3$ is $(CH_3)SiO_{3/2}$, $Q^2$ is $SiO_{2/2}(OH)_2$, $Q^3$ is $SiO_{3/2}(OH)$ and $Q^4$ is $SiO_{4/2}$.

Particles Size analysis of the white organosilicone resin powder was undertaken using a Coulter LS 230 Laser Particles Size Analyser (from 0.04 μm to 2000 μm), in water, using the Mie theory and the standard Fraunhofer optical model calculation. The particle size distribution of these organosilicone resin is polydispersed and centred (50% in volume) at a particle diameter of below 110 μm.

EXAMPLE 9

A trimethylsilyl-terminated-polyhydrogenmethylsiloxane (TMS-t-PHMS) hereafter called silicone fluid having a viscosity of 30 mPa·s, an average degree of polymerisation of 60 and containing 100% of hydrogen methyl siloxy units, was introduced in a low pressure glow discharge oxygen (99.9995%) plasma reactor.

The silicone fluid (2 ml) was placed in a petri dish to increase the surface /volume ratio. Upon plasma treatment lasting 15 minutes a white powder was collected on the wall of the chamber.

The white powder was analysed by $^{29}$Si solid-state NMR with a cross-polarisation magic angle spinning and magic angle spinning inverse gated decoupling modes to obtain a qualitative and semi-quantitative analyses of the chemical structure. The white powder was found to be an organosilicone resin.

Examples 2 to 4 show that the PDMS chemical structure is modified in the same way by either an air or oxygen plasma treatment. Increasing the plasma treatment time or the residence time in the plasma increases the amount of resinous material formed. Example 4 shows formation of powder that is a polysiloxane resin. Examples 6 and 7 show that the transformation of the polysiloxane from linear structure to a three-dimensional structure is due to plasma treatment alone.

The invention claimed is:

1. A method of forming a product selected from at least one of a gel and a powder, the method comprising oxidatively treating a liquid precursor in at least one of a non-thermal equilibrium plasma discharge and an ionized gas stream resulting therefrom and collecting the resulting product, wherein the liquid precursor is selected from at least one organometallic liquid precursor, at least one organometalloid liquid precursor, and mixtures thereof and wherein the liquid precursor is introduced into the non-thermal equilibrium plasma in the form of an atomized liquid.

2. A method in accordance with claim 1 wherein the liquid precursor is transported through at least one of an atmospheric plasma discharge and an ionized gas stream resulting therefrom, by being dropped under gravity or entrained in a carrier gas.

3. A method in accordance with claim 1 wherein the atomized liquid is introduced into the non-thermal equilibrium plasma by direct injection.

4. A method in accordance with claim 1 wherein the non-thermal equilibrium plasma is an atmospheric plasma glow discharge.

5. A method in accordance with claim 1 wherein the non-thermal equilibrium plasma is selected from a continuous low pressure glow discharge plasma, a low pressure pulse plasma and a dielectric barrier discharge.

6. A method in accordance with claim 1 wherein the liquid precursor is at least one of an organometallic compound of titanium, zirconium, iron, aluminium, indium and tin.

7. A method in accordance with claim 1 wherein the liquid precursor is an organometalloid compound of germanium or silicon.

8. A method in accordance with claim 7 wherein the silicon organometalloid compound is an organopolysiloxane having a viscosity of from 0.65 mPa·s. to 1000 mPa·s.

9. The method according to claim 1 wherein the step of treating is carried out using an apparatus comprising a means for generating a nonthermal equilibrium plasma, a means of at least one of introducing and retaining liquid precursor, wherein the means of introducing the liquid precursor is an atomizer.

10. The method in accordance with claim 9 wherein said apparatus is an atmospheric pressure glow discharge assembly wherein the atmospheric plasma is generated between spaced apart parallel electrodes which are flat, parallel or concentric parallel electrodes.

11. The method in accordance with claim 9 comprising a pair of vertically arrayed, parallel spaced-apart planar electrodes with at least one dielectric plate between the pair of electrodes, adjacent one electrode, the spacing between the dielectric plate and the other dielectric plate or electrode forming a plasma region.

12. The method in accordance with claim 11 wherein each electrode is in the form of a watertight box having a side formed by a dielectric plate having bonded thereto on the interior of the box a planar electrode together with a liquid inlet adapted to spray water or an aqueous solution onto the face of the planar electrode.

13. A method in accordance with claim 7 wherein the silicon organometalloid compound is an organopolysiloxane having a viscosity of from 100 mPa·s to 1,000,000 mPa·s. dissolved in at least one of an organic solvent and an organosilicone solvent.

* * * * *